United States Patent [19]

Matsumoto

[11] 4,125,193

[45] Nov. 14, 1978

[54] CLIMBING DEVICE FOR CLIMBING CRANE

[75] Inventor: Shigeto Matsumoto, Kawaguchi, Japan

[73] Assignee: Ishikawajima-Harima Jukogyo Kabushiki Kaisha, Ote, Japan

[21] Appl. No.: 841,114

[22] Filed: Oct. 11, 1977

[30] Foreign Application Priority Data

Oct. 15, 1976 [JP] Japan ..... 51-138416[U]

[51] Int. Cl.[2] ..... B66C 23/02

[52] U.S. Cl. ..... 212/64; 52/122; 254/105

[58] Field of Search ..... 212/33, 34, 46 B, 57, 212/64; 254/105–111; 52/122, 123

[56] References Cited

U.S. PATENT DOCUMENTS

| | | | |
|---|---|---|---|
| 3,464,169 | 9/1969 | Potain | 212/57 X |
| 3,656,631 | 4/1972 | Rauch et al. | 212/57 |

*Primary Examiner*—Robert G. Sheridan

*Attorney, Agent, or Firm*—Scrivener, Parker, Scrivener & Clarke

[57] ABSTRACT

A climbing device for a climbing crane wherein two upper supporting arms are supported vertically movably by a main cylinder having its upper end pivoted to the upper portion of a guide frame which in turn is intrusively attached to a mast, and two lower supporting arms are supported by the lower portion of the guide frame whereby climbing or descending is carried out by effectively taking advantage of the upper and lower supporting arms.

6 Claims, 5 Drawing Figures

CLIMBING DEVICE FOR CLIMBING CRANE

DETAILED DESCRIPTION OF THE INVENTION

The present invention relates to generally a climbing crane and more particularly a climbing device thereof.

With increase in height of buildings or the like there has been a strong demand for a climbing crane which is compact in size, light in weight and safe in operation. Almost all of the conventional climbing cranes were of wire rope type so that they were relatively inexpensive. However, accidents happened due to the parting of hoisting ropes and the reeving of hoisting ropes was very cumbersome. In order to overcome these problems, the hydraulic climbing cranes were devised and almost all of the recent climbing cranes are of hydraulic type.

In FIGS. 1 and 2 there is shown a typical hydraulic climbing crane. Hydraulically operated, horizontally movable supporting beams *d* and *e* are mounted on upper and lower frames *b* and *c*, respectively, which in turn are mounted on masts *a* and are interconnected with each other by main hydraulic cylinders *f*. The climbing device with the above construction climbs up or down step by step like a measuring worm on transverse beams *g* extended between the masts *a*. That is, in climbing the lower supporting beam *e* is extended to rest on the transverse beam *g* thereby to support the weight of the climbing device. Thereafter the upper supporting beam *d* is retracted away from the transverse beam *g*, and the main cylinders *f* are extended to raise the upper frame *b* and a structure mounted thereon. In the vicinity of the upward stroke of the main cylinders *f*, the upper supporting beam *d* is extended to rest on the transverse beam *g*, and the main cylinders *f* are retracted to raise the lower supporting beam *e* away from the transverse beam *g*. Thereafter the lower supporting beam *e* is retracted away from the transverse beam *g*, and the main cylinders *f* are further retracted so that the lower frame *c* is raised. When the lower frame *c* is lifted a predetermined distance, the lower supporting beam *e* is extended again to rest on the next higher transverse beam *g*. In this manner the climbing device may be lifted to a desired place.

However the prior art climbing device has the following problems.

(a) The stroke of the main cylinders *f* is dependent upon the pitch of the transverse beams *g* extended between the masts *a*. That is, as shown in FIG. 2 the whole stroke of the main cylinders *f* must be $L + \alpha$, where $L$ = the pitch of the transverse beams *g* and $\alpha$ = the length (in general about 100 mm) required for extending and retracting the upper and lower supporting beams *d* and *e*.

(b) Since the climbing device is divided into the upper and lower frames *b* and *c*, first the lower frame *c* must be mounted on the masts *a* and then the main cylinders *f* are mounted on the lower frame *c* and the upper frame *b* must be mounted on the masts *a*. As a result the installation is cumbersome and time-consuming.

In general the longer the pitch of the transverse beams or the holes in the masts, the more economical the installation becomes and the lighter in weight the climbing device becomes. On the other hand, the shorter the stroke of the main cylinders, the more economical the main cylinders become and the more compact in construction the climbing device becomes. So far no prior art climbing crane had successfully solved these two contradicting problems.

In view of the above, one of the objects of the present invention is to provide a climbing crane wherein the main cylinders may have a shorter stroke without shortening the pitch of the transverse beams or holes so that the climbing crane may be made compact in size, light in weight and inexpensive in cost.

Another object of the present invention is to provide a climbing crane which may be transported in an efficient manner, may be installed in a simple manner and may be operated in a safeguarded manner.

The above and other objects, features and advantages of the present invention will become more apparent from the following description of one preferred embodiment thereof taken in conjunction with the accompanying drawings, in which.

Figure 3:
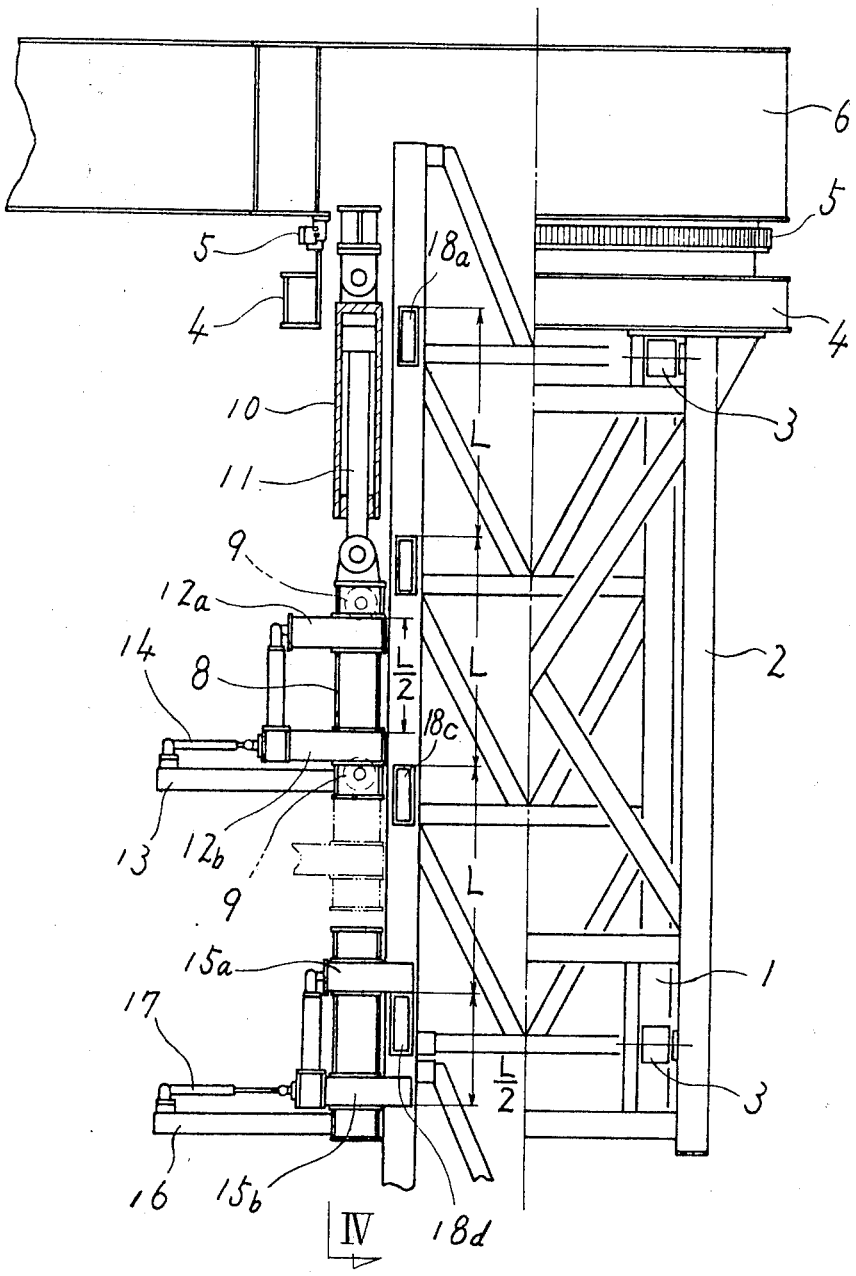
FIG. 3 is a front view, partly in section, of one preferred embodiment of a climbing device of a climbing crane in accordance with the present invention.
Figure 4:
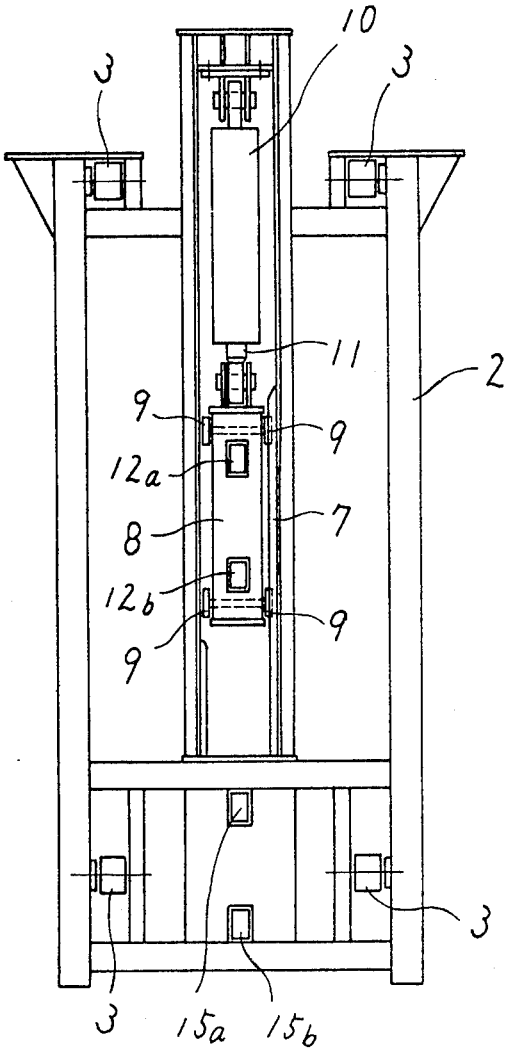
FIG. 4 is a view looking in the direction indicated by the arrow IV of FIG. 3.

Referring first to FIGS. 3 and 4, a rectangular guide frame 2 having 16 guide rollers 3 (a pair of rollers 3 at each corner) is mounted on mast 1 having transverse beams 18*a*–18*d* extended therebetween, and a turntable supporting frame 4 is mounted on the guide frame 2. A turntable bearing 5 is mounted on the supporting frame 4 and a turntable 6 is mounted on the bearing 5. The guide frame 2 includes a vertically movable frame 8 having four rollers 9 on vertical guide rails 7 attached to the guide frame 2. The top or head of main cylinder 10 is pivoted to the top of the guide frame 2, and the lower end of a rod 11 of the main cylinder 10 is pivoted to the upper end of the movable frame 8 so that upon retraction or extension of the main cylinder the movable frame 8 is caused to move upward or downward along the guide rails 7.

An upper supporting device comprises upper supporting arms 12*a* and 12*b* which are vertically spaced apart from each other by a suitable distance, integrally interconnected to each other and mounted on the movable frame 8 for horizontal movement, and a hydraulic upper locking cylinder 14 mounted on a supporting beam 13 extended from the lower end of movable frame 8 and connected to the upper supporting arms 12*a* and 12*b* for extending or retracting them through the movable frame 8 as will be described in detail hereinafter.

A lower supporting device comprising lower supporting arms 15*a* and 15*b* and a hydraulic lower locking cylinder 17 mounted on a supporting beam 16 extended from the lower end of the guide frame 2 is substantially similar in construction and mode of operation to the upper supporting device and is located immediately below the upper supporting device.

Figure 5:
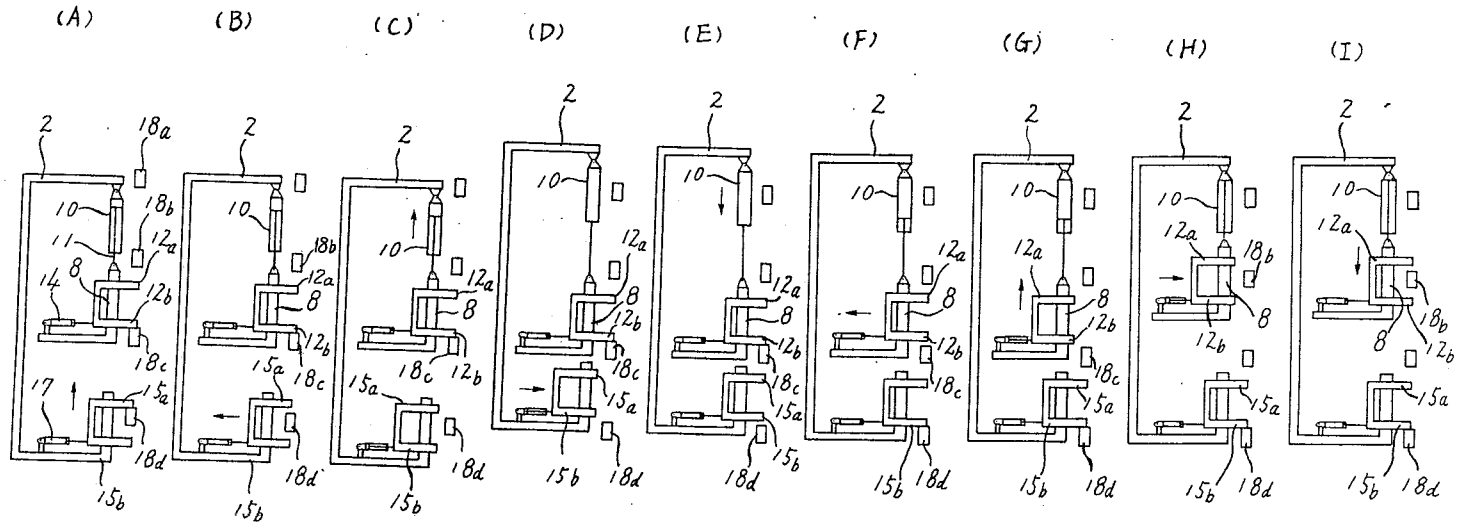
FIGS. 5(A)–5(I) are views used for the explanation of the mode of operation of the climbing device in accordance with the present invention.

Next with further reference to FIG. 5, the mode of climbing operation of the climbing device with the above construction will be described. At the initial position both the upper and lower locking cylinders 14 and 17 are extended so that the upper supporting arm 12*b* rests on the transverse beam 18*c* and the lower supporting arm 15*a* rests on the transverse beam 18*d* as shown in FIG. 5(A). And the main cylinder 10 is retracted. The first step is to extend the main cylinder 10. Since the rod 11 is pivoted to the movable frame 8 which in turn is supported on the transverse beam 18*c* through the upper supporting device as shown in FIG. 5(A) so that the rod 11 cannot extend downward. As a consequence the main cylinder 10 is extended upwardly as shown in FIG. 2(B) so that the guide frame 2 together with its upper structure and lower supporting device is lifted upward and consequently the lower supporting arms 15*a* is moved upward away from the transverse beam 18*d* as shown in FIG. 5(B). When the lower supporting arm 15*a* is spaced apart from the transverse beam 18*d* by a predetermined distance, the extension of the main cylinder 10 is suspended and the lower locking cylinder 17 is retracted so that the lower supporting arms 15*a* and 15*b* are retracted away from the transverse beam 18*d* in the direction indicated by the arrow in FIG. 5(B) to a position where they will not interfere with the beam 18*d*.

Thereafter the main cylinder 10 is extended again as shown in FIG. 5(C) so that the guide frame 4 with its upper structures 4 and 6 (See FIG. 1) and the lower supporting device is lifted upward. After the guide frame 2 has been lifted to a predetermined position, the extension of the main cylinder 10 is suspended as shown in FIG. 5(D), and the lower locking cylinder 17 is extended to extend the lower supporting arms 15*a* and 15*b* toward the transverse beam 18*d* until the lower supporting arm 15*b* is located above the beam 18*d* as shown in FIG. 5(E). Thereafter the main cylinder 10 is retracted. Since the downward movement of the rod 11 of the main cylinder 10 is locked as described above, the main cylinder 10 moves downward so that the guide frame 2 also moves downward along the mast 1. When the lower supporting arm 15*b* rests upon the transverse beam 18*d*, the downward movement of the guide frame 2 and hence the main cylinder 10 is prevented (See FIG. 5(F)) so that the rod 11 is retracted upward and consequently the upper supporting arm 12*b* is moved away from the transverse beam 18*c* as shown in FIG. 5(F). Thereafter the upper locking cylinder 14 is retracted to retract the upper supporting arms 12*a* and 12*b* away from the transverse beams 18*c* and 18*b* as shown in FIG. 5(F) and (G). The main cylinder 10 is further retracted so that the movable frame 8 and the upper supporting device mounted thereon are lifted upward as shown in FIG. 5(G) and (H). After they are lifted by a predetermined distance, the main cylinder 10 is de-energized and the locking cylinder 14 is extended to extend the upper arms 12*a* and 12*b* toward the transverse beam 18*b* as shown in FIG. 5(I). Thereafter the main cylinder 10 is extended again so that the upper supporting arm 12*a* rests on the transverse beam 18*b*.

Upon completion of one cycle of these steps, the guide frame 2 is moved upward by a distance equeal to one half of the pitch of the transverse beams 18. The above cycle may be repeated as many times as desired until the guide frame 2 may be moved upward to a desired position.

In descending the climbing device, the steps are reversed and the descending cycles may be repeated until the guide frame 2 may be brought to a desired position.

So far the guide frame 2 has been described as being lifted or descended along the mast 1, but it is to be understood that the guide frame 2 may be securely attached to a floor or a transverse beam of a building so that the mast 1 may be lifted or lowered. In this case, upper surfaces of the supporting arms 12*a*, 12*b*, 15*a* and 15*b* are made into engagement with the lower surfaces of the transverse beams 18*a*–18*d*.

Figure 1:
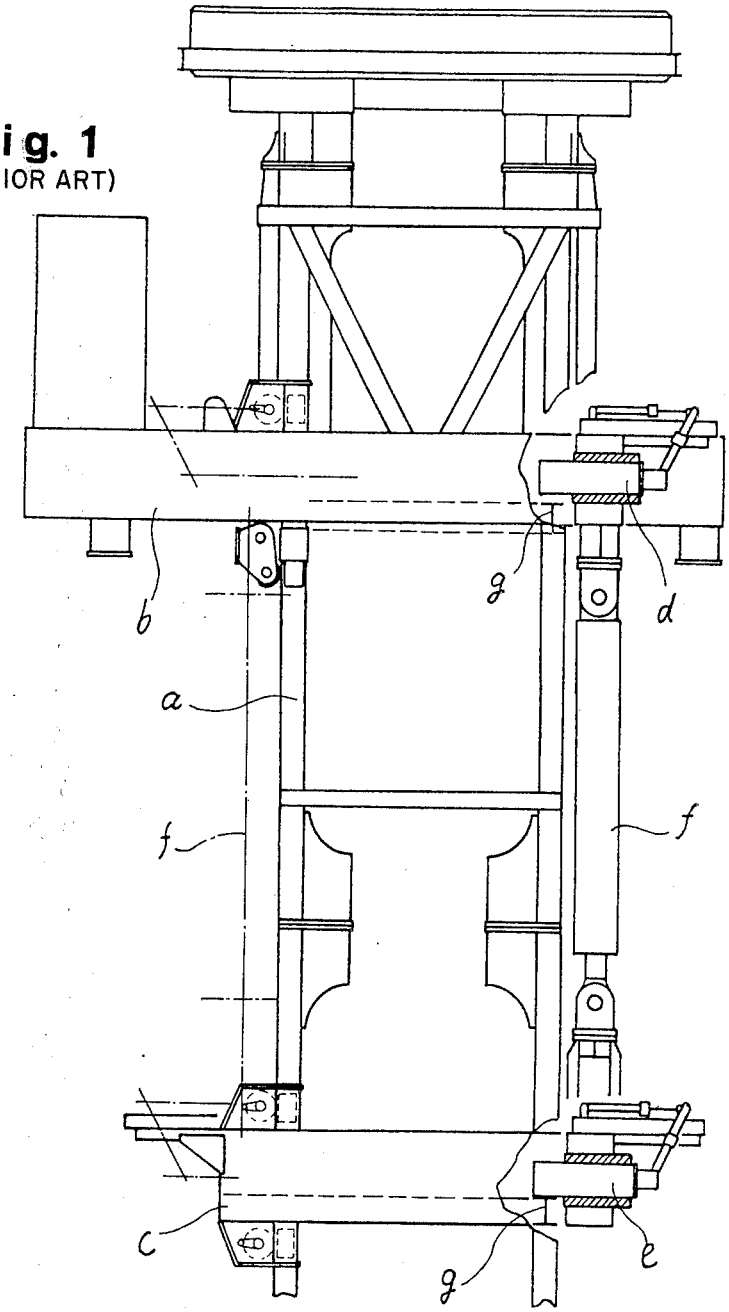
Fig. 1 (PRIOR ART)
FIG. 1 is a fragmentary front view of a typical prior art hydraulic climbing crane.
Figure 2:
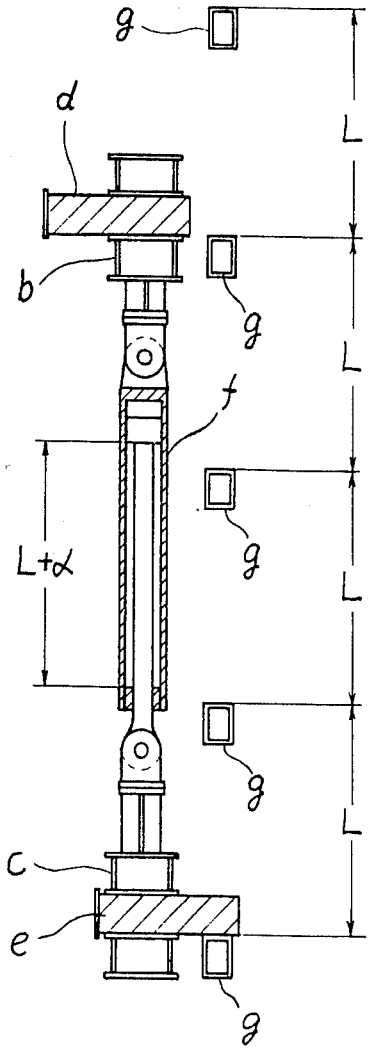
Fig. 2 (PRIOR ART)
FIG. 2 is a view used for the explanation of the stroke of the main cylinders thereof.

As described above the main cylinders of the prior art climbing device of the type shown in FIGS. 1 and 2 must have the maximum stroke of $(L + \alpha)$, but according to the present invention the stroke of the main cylinder 10 may be reduced to $(L/2 + \alpha)$ as shown in FIG. 3. For instance when the pitch of the transverse beams is 1,500 mm and $\alpha$ is about 100 mm, then the maximum stroke of the main cylinders of the prior art climbing crane is $$l = 1{,}500 + 100 = 1{,}600 \text{ mm}$$

but the maximum stroke of the main cylinder 10 of the present invention is $$l = 1{,}500/2 + 100 = 850 \text{ mm.}$$

Since the stroke of the main cylinder may be shortened, the height of the climbing device in accordance with the present invention may be shortened accordingly. When the prior art climbing crane is installed, first two masts must be joined together. (One mast is 6 m in length so that the height of two joined masts is 12 m). When the turntable or the like is installed in such a manner that it may rotate about these masts, it must be lifted above the mast. As a result, a heavy-duty crawler crane having a suitable radius, capacity and lift must be used. With the climbing device in accordance with the present invention, however, joining of masts is not needed. That is, mast of 6 m in height is first erected so that a light duty crawler crane may be used. Furthermore since the guide frame 2 includes the main cylinder 10 and the movable frame, the transportation and handling may be much facilitated.

So far one locking cylinder 14 or 17 is used for extending or retracting the supporting arms 12*a* and 12*b* or 15*a* and 15*b*, but it is to be understood that one locking cylinder may be provided for each of the supporting arms. Furthermore instead of using the locking cylinders 14 and 17, the upper and lower supporting arms may be manually extended or retracted.

The guide rollers 3 of the guide frame 2 are of an eccentric shaft construction so that they may be freely extended or retracted by the rotation of their shafts. As a consequence after the lower supporting arm 15*a* attached to the guide frame 2 has been rested on the transverse beam 18*c* or 18*d*, the eccentric shafts of the rollers 3 may be rotated so that the clearance between the rollers 3 and the mast 1 may become zero before the loading or unloading operation is started.

The climbing device in accordance with the present invention may be used in conjunction with a fixed type climbing crane of the type having its mast erected on the ground inside or outside of a building, a floor climbing type crane of the type wherein a mast of a predetermined height is erected on a floor of a building so that the climbing device may be lifted to any height and a self-propelled type climbing crane.

The advantages of the climbing device in accordance with the present invention may be summarized as follows:

(i) The stroke of the main cylinder may be shortened about one half of the stroke of the main cylinders of the prior art climbing device without changing the pitch of the transverse beams. Therefore the climbing device of the present invention is very economical.

(ii) The height of the climbing device may be reduced so that when the crane is installed, a light duty crane may be used. Furthermore the installation is made at a relatively lower position so that the installation is safe.

(iii) Since the stroke of the main cylinder as well as the pitch between the upper and lower supporting devices are short, even when the climbing device should fall, the falling distance is very short and consequently the operation is safeguarded.

(iv) Since the upper and lower supporting devices are provided and because one of them is always in engagement with the transverse beam, the operation is further safeguarded.

(v) Since the climbing device is compact in size and light in weight, the crane itself may be made light in weight. As a result the basic load exerted on beams or floors of a building may be reduced.

(vi) When the stroke of the main cylinder of the climbing device of the present invention is doubled, the pitch of the transverse beams may be also doubled as compared with the prior art climbing cranes so that mast light in weight may be used and consequently the fabrication cost may be reduced.

(vii) The main cylinder and the movable frame are incorporated into the guide frame so that the number of components to be assembled on a job site is minimum. As a result, the transportation, handling and installation may be much facilitated. That is, labor savings may be attained and the installation period may be considerably shortened.

(viii) The upper and lower supporting devices may function as the supporting beams or the like for supporting the vertical load of the turntable or the like. Therefore the climbing device in accordance with the present invention is very economical.

What is claimed is:

1. A climbing device for a climbing crane comprising
(a) a guide frame mounted on a mast for vertical movement,
(b) a movable frame mounted on said guide frame for vertical movement along guide rails attached to said guide frame,
(c) a main cylinder having the upper end pivoted to the upper end of said guide frame and having the lower end connected to said movable frame,
(d) an upper supporting means including two vertically spaced supporting arms which are mounted on said movable frame for movement into and away from said mast, and
(e) a lower supporting means including two vertically spaced supporting arms which are mounted on said guide frame immediately below said upper supporting means for movement into and away from said mast, said lower supporting means being spaced apart from said upper supporting means by a predetermined distance, whereby when said main cylinder is energized after said lower supporting means has been moved into said mast, said movable frame and hence said upper supporting means is caused to move upward or downward and when said main cylinder in energized after said upper supporting means has been moved into said mast said guide frame and hence said lower supporting means is caused to move upward or downward.

2. A climbing device as set forth in claim 1 wherein said two supporting arms of each of said upper and lower supporting means are vertically spaced apart from each other be a distance equal to about one half of the pitch of transverse beams extended within said mast.

3. A climbing device as set forth in claim 1 wherein said two arms of each of said upper and lower supporting means are moved into or away from said mast by hydraulic locking cylinders, respectively.

4. A climbing device as set forth in claim 1 wherein said two arms of each of said upper and lower supporting means are connected to each other so that they may be simultaneously moved into or away from said mast in unison with each other by a single hydraulic locking cylinder.

5. A climbing device as set forth in claim 2 wherein said two arms of each of said upper and lower supporting means are moved into or away from said mast by hydraulic locking cylinders, respectively.

6. A climbing device as set forth in claim 2 wherein said two arms of each of said upper and lower supporting means are connected to each other so that they may be simultaneously moved into or away from said mast in unison with each other by a single hydraulic locking cylinder.

* * * * *